United States Patent [19]

Sakai

[11] 4,388,393

[45] Jun. 14, 1983

[54] HYDRAZONE COMPOUND, WITH HYDROXYETHYL GROUP IN CHARGE TRANSFER LAYER

[75] Inventor: Kiyoshi Sakai, Numazu, Japan

[73] Assignee: Ricoh Co., Ltd., Tokyo, Japan

[21] Appl. No.: 239,954

[22] Filed: Mar. 3, 1981

[30] Foreign Application Priority Data

Mar. 13, 1980 [JP] Japan ..... 55-32420
Apr. 8, 1980 [JP] Japan ..... 55-46019

[51] Int. Cl.[3] ..... G03G 5/14
[52] U.S. Cl. ..... 430/59; 430/58
[58] Field of Search ..... 430/58, 59, 70, 73, 430/74

[56] References Cited

U.S. PATENT DOCUMENTS 3,066,023 11/1962 Schlesinger ..... 430/74 X
4,150,987 4/1979 Anderson et al. ..... 430/58
4,256,821 3/1981 Enomoto et al. ..... 430/58 X
4,278,747 7/1981 Murayama et al. ..... 430/58 X
4,284,698 8/1981 Kazami et al. ..... 430/58 X

FOREIGN PATENT DOCUMENTS 930988 7/1963 United Kingdom ..... 430/70

*Primary Examiner*—Roland E. Martin, Jr.
*Attorney, Agent, or Firm*—Flynn, Thiel, Boutell & Tanis

[57] ABSTRACT

A novel hydrazone compound having the following general formula I is disclosed, along with, a manufacturing process for same and a layered electrophotographic element comprising, in successive layers, an electrically conductive substrate, a charge carrier generating layer and a charge transfer layer containing said hydrazone compound:

(wherein R is hydrogen, an alkyl group, an alkoxy group or a dialkylamino group, and n is an integer of 1 to 3.)

12 Claims, 6 Drawing Figures

HYDRAZONE COMPOUND, WITH HYDROXYETHYL GROUP IN CHARGE TRANSFER LAYER

BACKGROUND OF THE INVENTION (a) Field of the Invention

The present invention relates to a novel hydrazone compound which is usable as a charge transfer material and is represented by the general formula I:

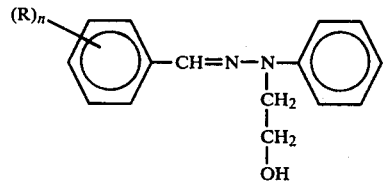

(wherein R is hydrogen, an alkyl group, an alkoxy group or a dialkylamino groups, and n is an integer of 1 to 3), a manufacturing process for the compound and its application in electrophotographic elements.

(b) Description of the Prior Art

Inorganic substances such as selenium, cadmium sulfide, zinc oxide, etc. have hitherto been employed as photoconductive materials for electrophotographic elements used in electrophotographic processes. In this context, it is to be noted that the term "electrophotographic process" referred to herein generally denotes one of the image forming methods which comprises the steps of first electrifying an electrophotographic element in the dark, for instance with corona discharge or the like, then subjecting the element to imagewise exposure for selectively dissipating the charge from only the light struck portions of the element, thereby forming a latent image, and rendering the latent image visible by virtue of a developing process utilizing an electroscopic fine powder comprising a coloring agent called a toner, such as a dye, pigment or the like and a binder resin such as a high molecular weight substance or the like, thereby forming a visible image. The element adapted for the above-mentioned electrophotographic process is required to have the following fundamental characteristics: (1) chargeability to a suitable potential in the dark, (2) low charge-dissipation in the dark, and (3) rapid dischargeability on irradiation of light. The hitherto utilized inorganic substances as enumerated above surely possess a number of merits but at the same time have various inherent demerits. In order to remove these inherent drawbacks, in recent years there have been proposed electrophotographic elements employing various kinds of organic substances, and some of these are now put to practical use. It is known that an electrophotographic element comprising a material capable of generating a charge carrier on absorption of light (which will be referred to as a charge carrier generating material hereinafter) and a material capable of accepting as well as transferring the charge carrier thus generated (which will be referred to as a charge transfer substance hereinafter) can exhibit a hitherto unexperienced high sensitivity since it can utilize a wide variety of materials suitable for each of the charge carrier generating and transferring functions as compared with an electrophotographic element wherein one and the same material is designed to generate a charge carrier as well as transfer same. The materials suitably used in the electrophotographic element of this sort are required to meet the following requirements: in the case of the charge carrier generating substance, it should generate a charge carrier on absorption of a desired light; it should generate a charge carrier with a high efficiency; and it should be readily processed in the preparation of the electrophotographic element and the like. The charge transfer substance should easily accept the charge carrier from the charge carrier generating substance; it should transfer the charge swiftly; it should exhibit no absorption in the photosensitive region of the charge carrier generating material and the like. In this connection, it should be particularly taken into consideration that the charge carrier generating material and the charge transfer material suitable therefor are inseparably related to each other. In other words, when the combination of the charge carrier generating material and the charge transfer material is unfit, it results in that a satisfactory charge potential can not be obtained in the dark, the dissipation of charge on irradiation of light is not effected satisfactorily and consequently the image to be obtained is low in image density and the background is stained. Generally speaking, there is noted such a tendency that the material which exhibits a high charge potential in the dark is inferior in the dissipation of charge, while the one which is superior in the dissipation of charge is low in the charge potential. However, this tendency varies with the kind of the charge carrier generating material to be employed and also the kind of the charge transfer material to be employed. It is preferable from the practical viewpoint to choose a suitable combination which is capable of dissipating the charge to such an extent that the background is not stained and attaining a charge potential sufficient to obtain a satisfactory image density.

A multiplicity of charge carrier generating materials have hitherto been proposed. As the particularly effective ones there can be enumerated, for instance, CI Pigment Blue 25 (color index 21180), an azo pigment having a carbazole skeleton (Japanese Laid-open Patent Application No. 95033/1978), an azo pigment having a triphenylamine skeleton (Japanese Laid-open Patent Application No. 132347/1978), an azo pigment having a styrylstilbene skeleton (Japanese Laid-open Patent Application No. 133445/1978), an azo pigment having a diphenyloxadiazole skeleton (Japanese Laid-open Patent Application No. 12742/1979), an azo pigment having a fluorenone skeleton (Japanese Laid-open Patent Application No. 22834/1979) and the like. In this connection, it is to be noted that for the above-mentioned reason, a suitable charge transfer substance should be selected in conformity with a charge carrier generating substance to be employed.

SUMMARY OF THE INVENTION

I have carried out a series of studies on a variety of charge transfer materials to find that when investigating the magnitude of the electric charge potential and the difficulty or ease of dissipating the charge referred to above, from the viewpoint of chemical structure of each charge transfer substance, the one having an electron donative group introduced therein can dissipate the charge more efficiently. The present invention has been completed on the basis of this finding.

The first object of the present invention, accordingly, is to provide the hydrazone compound having the following general formula I as the charge transfer material which, when used in conjunction with a variety of charge carrier generating materials, is capable of having a satisfactory charge potential in the dark and dissipating the charge rapidly on irradiation of light:

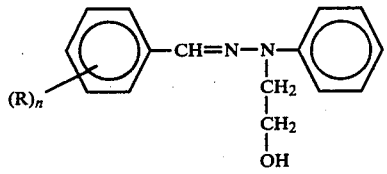

(wherein R is hydrogen, an alkyl group, an alkoxy group, a dialkylamino group or a dibenzylamino group, and n is an integer of 1 to 3.)

The second object of the present invention is to provide a process for manufacturing said novel hydrazone compounds wherein benzaldehydes having the general formula II:

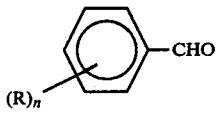

(wherein R and n are the same as in the general formula I) are reacted with 1-(β-hydroxyethyl)-1-phenylhydrazine having the formula:

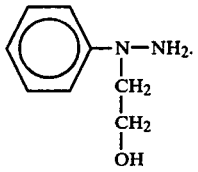

The other object of the present invention is to provide an electrophotographic element which comprises, in successive layers, an electrically conductive substrate, a charge carrier generating layer and a charge transfer layer containing a hydrazone compound represented by the general formula I as an effective ingredient.

As the hydrazones of this sort there have already been proposed N,N-diphenyl and N-methyl-N-phenyl hydrazones (Japanese Laid-open Patent Application No. 59143/1979, etc.) The charge transfer materials disclosed in these applications are surely effective with some charge carrier generating materials, but they are not always effective with every charge carrier generating material. The compounds of the present invention exert a particularly effective action upon such charge carrier generating materials. These hydrazone compounds take the form of colorless or light yellow crystals at normal temperature and can be obtained readily by causing a reaction between said aldehyde and said hydrazine in equimolar quantities in a suitable organic solvent. However, when taking the yield and the easiness of purification into consideration, it is preferable that said hydrazine should be used in an excess quantity. It is generally known that this reaction can be enhanced by the addition of an acid. This acid catalyst includes mineral acids such as hydrochloric acid, dilute sulfuric acid, etc., and organic acids such as acetic acid. As the reaction solvent there can be employed almost all the organic solvents capable of dissolving the raw materials well. Such organic solvents include, for instance, lower alcohols such as methanol, ethanol, etc., cyclic ethers such as 1,4-dioxane, tetrahydrofuran, etc., cellosolves such as methyl cellosolve, ethyl cellosolve, etc., N,N-dimethylformamide, acetic acid and the like. The reaction temperature, which varies depending on the reaction solvent to be employed, can be selected optionally from the range of from room temperature to the boiling point. In case a solvent is employed in which the raw materials are difficult to dissolve, it is preferable to elevate the temperature in order to dissolve the raw materials, while in case a solvent is employed in which the raw materials are easy to dissolve, the reaction is carried out at room temperature. In either case, the reaction is completed in 1 to 5 hours. Since the compound of the present invention is easy to dissolve in general organic solvents, when one of the above mentioned organic solvents is employed as the reaction solvent, there can be obtained a uniform solution. A raw product is obtained in solid form from this reaction mixture by distilling out the reaction solvent and treating the resulting resinous substance with dilute acetic acid. When acetic acid is employed as the reaction solvent, a raw product is obtained in solid form readily by diluting the reaction solution with water. A pure hydrazone compound can be obtained by re-crystallizing the thus obtained raw product from a suitable solvent.

The thus obtained novel hydrazone compounds according to the present invention are enumerated as follows:

| Structural formula | Compound No. |
|---|---|
| 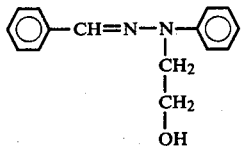 | (1) |
| The common portion "—CH=N—N— 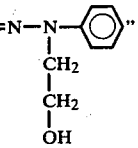 " shall be written in abbreviated form as "—Y" hereinafter. | |
| 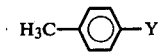 | (2) |
| 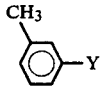 | (3) |
| 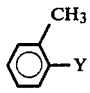 | (4) |
| 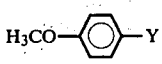 | (5) |
| 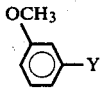 | (6) |

-continued

| Structural formula | Compound No. |
|---|---|
| 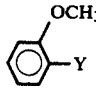 | (7) |
| 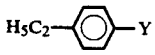 | (8) |
| 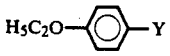 | (9) |
| 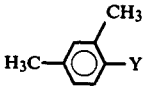 | (10) |
| 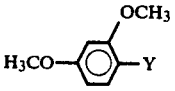 | (11) |
| 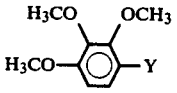 | (12) |
| 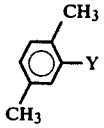 | (13) |
| 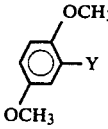 | (14) |
| 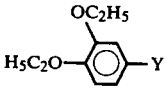 | (15) |
| 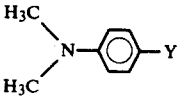 | (16) |
| 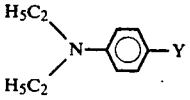 | (17) |
| 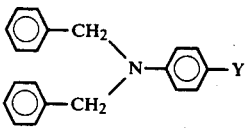 | (18) |
| 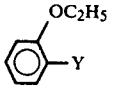 | (19) |
| 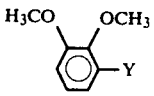 | (20) |

-continued

| Structural formula | Compound No. |
|---|---|
| 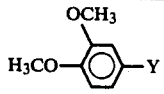 | (21) |
| 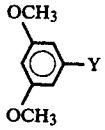 | (22) |
| 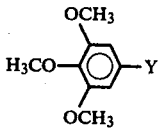 | (23) |
| 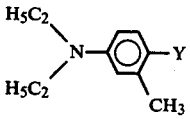 | (24) |

When in the general formula I of the present invention R is an alkyl group or an alkoxy group or a dialkylamino group, each alkyl group has 1 to 6 carbon atoms. The concrete examples are methyl, ethyl, propyl, isopropyl, butyl, isobutyl, pentyl, hexyl, etc. when R is an alkyl group; methoxy, ethoxy, propoxy, iospropoxy, butoxy, isobutoxy, pentoxy, hexoxy, etc. when R is an alkoxy group; and dimethylamino, diethylamino, dipropylamino, diisopropylamino, dibutylamino, diisobutylamino, dipentylamino, dihexylamino, etc. when R is a dialkylamino group.

BRIEF DESCRIPTION OF THE DRAWINGS

Next, the electrophotographic element according to the present invention will be explained with reference to the accompanying drawings. FIG. 1 is a view illustrating one embodiment of the electrophotographic element according to the present invention which comprises, in successive layers, an electrically conductive substrate 1 and a photosensitive layer 2 consisting of a charge carrier generating layer 5 containing mainly a charge carrier generating substance 3 and a charge transfer layer 4 containing a hydrazone compound having the general formula I.

Figure 1:
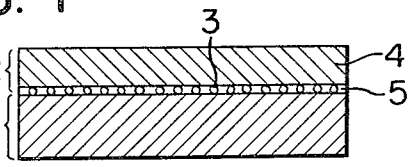
FIG. 1 is an enlarged cross-sectional view illustrating the electrophotographic element according to the present invention.

The hydrazone compound, which is a charge transfer material, forms a charge transfer media in conjunction with a binder (or a binder and a plasticizer), while the charge carrier generating material such as an inorganic or organic pigment acts to generate charge carriers. In this case, the main ability of the charge transfer media is to accept charge carriers generated from the charge carrier generating material and transfer said charge carriers. In this connection, it is to be noted that what is fundamentally required for the materials used in the electrophotographic element is that the absorption wave length regions of both the charge carrier generating material and the hydrazone compound should not overlap each other mainly in the visible light region. This is because it is to permit light to permeate to the surface of the charge carrier generating material in order that the latter may generate charge carriers efficiently. The hydrazone compound according to the present invention is characterized in that it is scarcely absorptive to the visible light region and acts as the charge transfer material effectively especially when combined with a charge carrier generating material capable of generating charge carriers upon absorbing the light in the visible region.

In the case of this electrophotographic element, the light permeated through the charge transfer layer 4 arrives at the charge carrier generating layer 5 to thereby generate charge carriers at the light struck portions thereof, while the thus generated charge carriers are injected in the charge transfer layer 4 and transferred therethrough. The mechanism employed herein is that the generation of charge carriers necessary for effecting light decay is allotted to the charge carrier generating material, while the transfer of charge carriers is allotted to the charge transfer medium (wherein the hydrazone compound of the present invention mainly acts for that purpose).

This electrophotographic element may be prepared by vacuum vapordepositing a charge carrier generating material onto an electrically conductive substrate or coating onto an electrically conductive substrate a dispersion obtained by dispersing fine particles of the charge carrier generating material, if needed, in a suitable solvent having a binder dissolved therein and drying, then by coating a solution containing the hydrazone compound and a binder onto the charge carrier generating layer, if further needed, after surface finishing or film thickness regulation by, for instance, buffing or the like, and drying. The coating method used herein includes conventional means, for instance, such as doctor blade, wire bar and the like.

Referring to the thickness of the photosensitive layer, it is desirable that the charge carrier generating layer is less than 5$\mu$ thick, preferably less than 2$\mu$ thick, and the charge transfer layer is between 3 and 50$\mu$ thick, preferably between 5 and 20$\mu$ thick.

The percentage of the hydrazone compound in the charge transfer layer of this electrophotographic element is between 10 and 95% by weight, preferably between 30 and 90% by weight.

In this context, it is to be noted that a plasticizer may be used in conjunction with a binder in the preparation of this electrophotographic element.

In the case of the electrophotographic element according to the present invention, as the electrically conductive substrate there can be employed a metallic plate or foil of aluminum or the like, a plastic film vapordeposited with a metal such as aluminum or the like, or an electro conductively treated paper or the like. As the binder suitably used in the present invention there can be employed condensation resins such as polyamide, polyester, epoxy resin, polyketone, polycarbonate, etc., polyurethane, or vinyl polymers such as polyvinyl ketone, polystyrene, poly-N-vinylcarbazole, polyacrylamide, acrylic resin, polyvinyl acetal, etc., and the like. In this connection, however, it is to be noted that any insulating as well as adhesive resin may be employed for this purpose. As the plasticizer for use in the present invention there may be enumerated paraffin halide, polybiphenyl chloride, dimethylnaphthalene, dibutyl phthalate and so forth.

The charge carrier generating materials for use in the present invention include inorganic compounds such as selenium, selenium-tellurium alloys, cadmium sulfide, cadmium sulfide-selenium alloys, etc.; and organic compounds such as disazo or trisazo pigments like CI Pigment Blue-25 (CI 21180), CI Pigment Red 41 (CI 21200), CI Acid Red 52 (CI 45100), CI Basic Red 3, the disazo pigment having a carbazole skeleton (Japanese Laid-open Patent Application No. 95033/1978), the disazo pigment having a styryl stilbene skeleton (Japanese Laid-open Patent Application No. 133445/1978), the trisazo pigment having a triphenylamine skeleton (Japanese Laid-open Patent Application No. 132347/1978), the disazo pigment having a dibenzothiophene skeleton (Japanese Laid-open Patent Application No. 21728/1979), the disazo pigment having an oxadiazole skeleton (Japanese Laid-open Patent Application No. 12742/1979), the disazo pigment having a fluorenone skeleton (Japanese Laid-open Patent Application No. 22834/1979), the disazo pigment having a stilbene skeleton (Japanese Laid-open Patent Application No. 20737/1979), the disazo pigment having a distyryloxadiazole skeleton (Japanese Laid-open Patent Application No. 2129/1979), the disazo pigment having a distyrylcarbazole skeleton (Japanese Laid-open Patent Application No. 14967/1979), etc.; phthalocyanine type pigments such as CI Pigment Blue 16 (CI 74100), etc.; indigo type pigments such as CI Vat Brown 5 (CI 73410), CI Vat Dye (CI 73030), etc.; perylene type pigments such as Indanthrene Scarlet R (produced by Bayer Company) and so forth.

In this connection, it is to be noted that the photosensitive element thus obtained can have an adhesive or barrier layer, if needed, interposed between the electrically conductive substrate and the photosensitive layer. The materials suitably used for said adhesive or barrier layer include polyamide, nitrocellulose, aluminum oxide, etc., and preferably the film thickness of said layer is 1 micron or less.

The copying process using the electrophotographic element of the present invention can be achieved by electrifying the surface of the element, exposing the same to light, thereafter developing and, if needed, transferring the thus formed image onto paper or the like.

The electrophotographic element according to the present invention is advantageous in that it is generally of a high sensitivity and flexibility.

DESCRIPTION OF THE PREFERRED EMBODIMENTS

Example 1

Preparation Example of Compound (1)

2.12 gr (0.02 mole) of benzaldehyde and 4.57 gr (0.03 mole) of 1-($\beta$-hydroxyethyl)-1-phenylhydrazine were added to 50 ml of ethanol, several drops of 1 N-HCl were added to the same, and then the mixture was subjected to 1 hour's heating and refluxing. The mixture was cooled and then the ethanol was distilled out thereof. The resulting oily matter was washed with n-hexane and solidified. The resulting solid matter was re-crystallized once from a methanol-water mixture solution and once from cyclohexane, whereby the intended hydrazone compound (1) was obtained in a quantity of 2.13 gr. The yield was 44.4% and the melting point was in the range of from 73.5° to 75.0° C.

| Elementary analysis | Measured value | Calculated value |
|---|---|---|
| C (%) | 75.30 | 74.97 |
| H (%) | 7.00 | 6.71 |
| N (%) | 11.90 | 11.66 |

Figure 2:
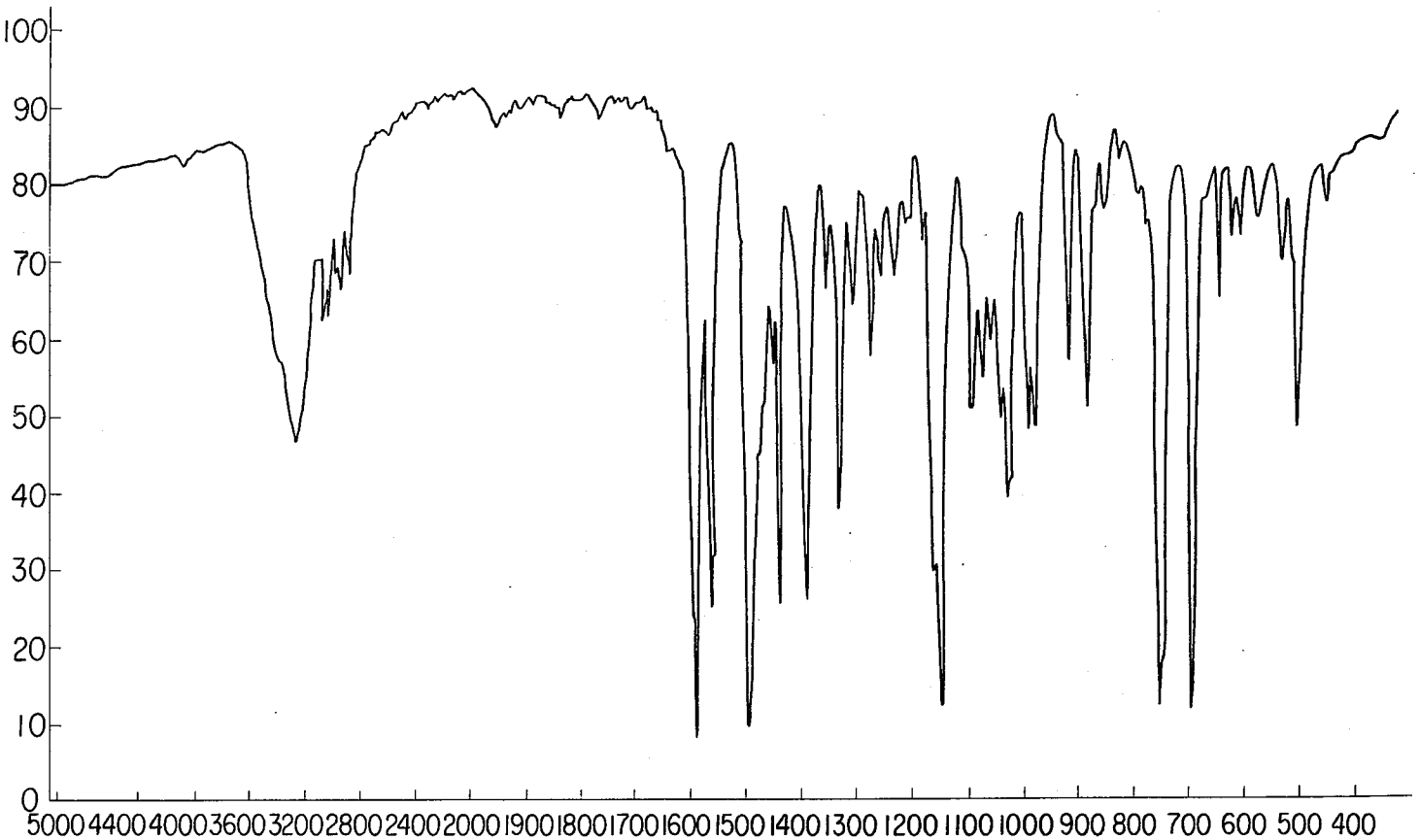
FIGS. 2 to 6 are views illustrating the infrared spectrums of the hydrazone compounds produced according to the procedures described in Examples 1 to 5 respectively.

The infrared absorption spectrum of the aforesaid compound (1) (KBr tablet method) is as shown in FIG. 2.

Example 2

Preparation Example of Compound (2)

2.40 gr (0.02 mole) of p-tolualdehyde and 6.09 gr (0.04 mole) of 1-(β-hydroxyethyl)-1-phenylhydrazine were added to 50 ml of ethanol, several drops of 1 N-HCl were added to the same, and then the mixture was subjected to 1 hour's heating and refluxing. The mixture was cooled and then the ethanol was distilled out. 50 ml of an aqueous 10% acetic acid solution was added to the resulting oily matter, which then was stirred and solidified. The resulting solid matter was recrystallized twice from a mixed solution of toluene and cyclohexane (3:7 volume ratio). Thus, the intended hydrazone compound (2) was obtained in a quantity of 2.0 gr. The yield was 39.4% and the melting point was in the range of from 88.5° to 89.5° C.

| Elementary analysis | Measured value | Calculated value |
|---|---|---|
| C (%) | 75.80 | 75.56 |
| H (%) | 7.24 | 7.13 |
| N (%) | 10.89 | 11.09 |

Figure 3:
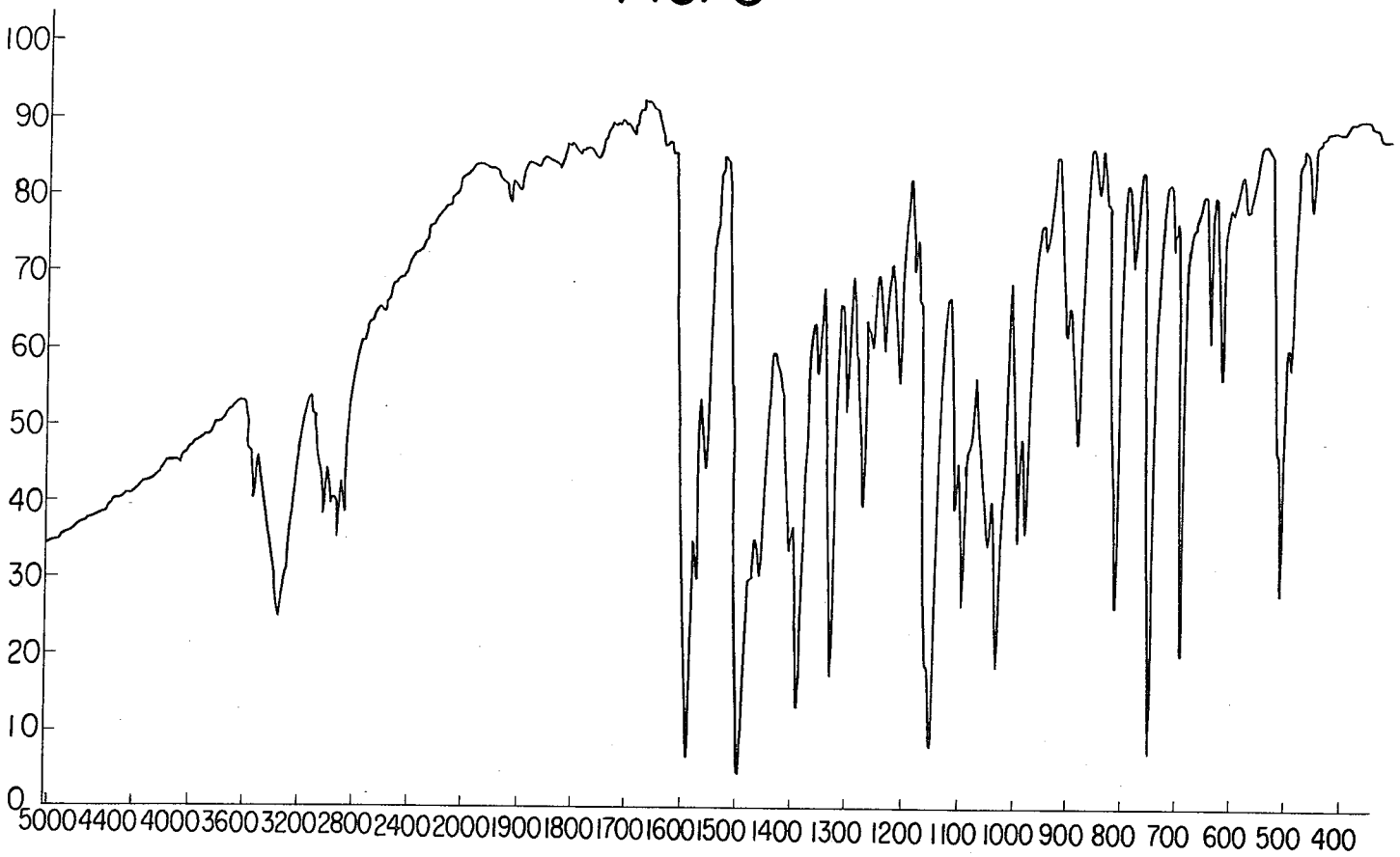

The infrared absorption spectrum of the aforesaid compound (2) (KBr tablet method) is as shown in FIG. 3.

Example 3

Preparation Example of Compound (5)

2.72 gr (0.02 mole) of p-anisaldehyde and 6.09 gr (0.04 mole) of 1-(β-hydroxyethyl)-1-phenylhydrazine were added to 50 ml of ethanol, several drops of 1 N-HCl were added to the same, and then the mixture was subjected to 1 hour's heating and refluxing. The mixture was cooled and then the ethanol was distilled out thereof. 50 ml of an aqueous 10% acetic acid solution were added to the resulting oily matter, which was then stirred and solidified. The resulting solid matter was recrystallized twice from a mixed solution of toluene and cyclohexane (3:7 volume ratio), whereby the intended hydrazone compound (5) was obtained in a quantity of 4.43 gr. The yield was 81.9% and the melting point was in the range of from 93.5° to 94.5° C.

| Elementary analysis | Measured value | Calculated value |
|---|---|---|
| C (%) | 71.04 | 71.09 |
| H (%) | 6.68 | 6.71 |
| N (%) | 10.31 | 10.36 |

Figure 4:
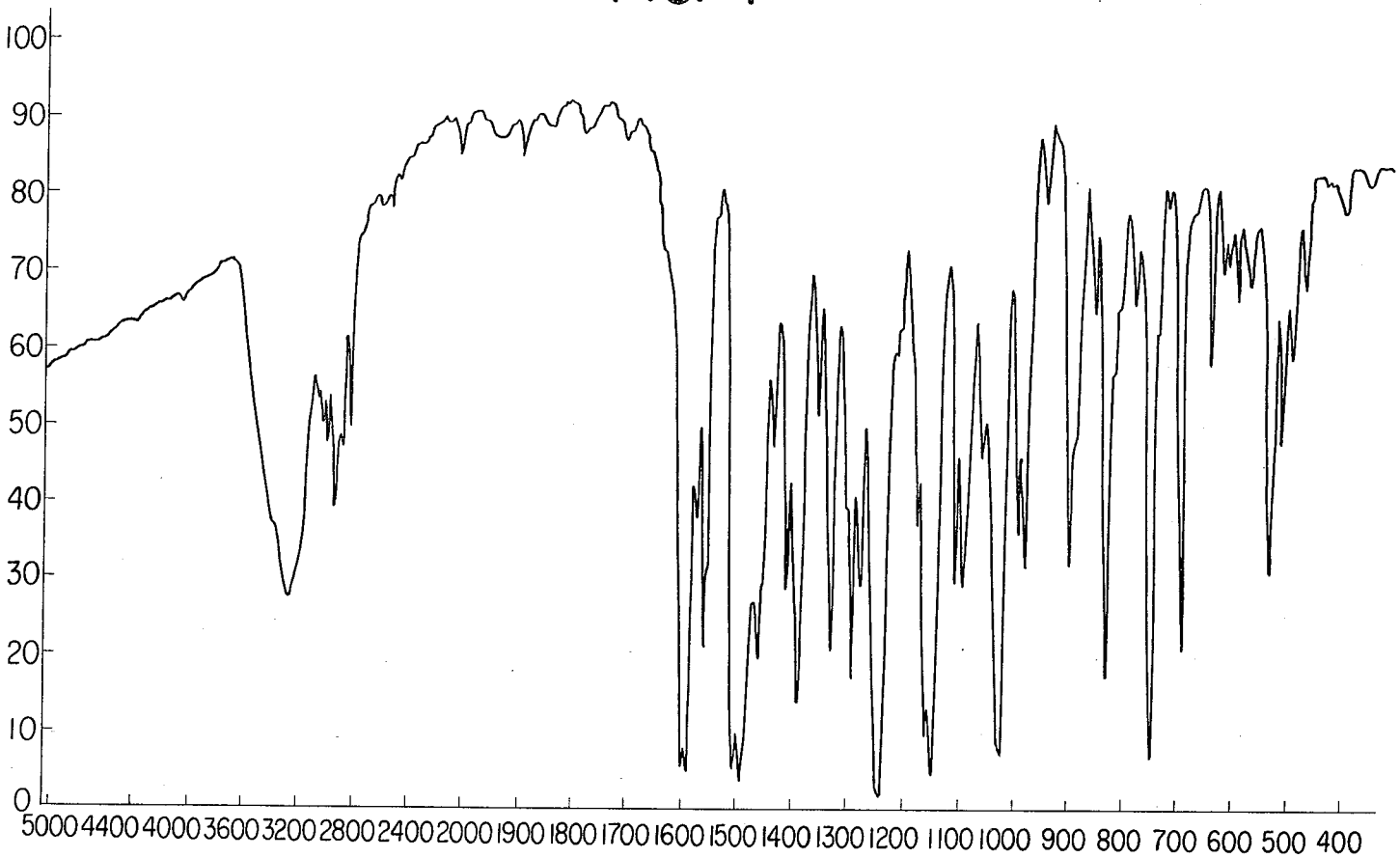

The infrared absorption spectrum of the aforesaid compound (5) (KBr tablet method) is as shown in FIG. 4.

Example 4

Preparation Example of Compound (16)

2.98 gr (0.02 mole) of 4-(N,N-dimethylamino)benzaldehyde and 6.09 gr (0.04 mole) of 1-(β-hydroxyethyl)-1-phenylhydrazine were added to 50 ml of acetic acid, and the same was subjected to 1 hour's heating and stirring at a temperature ranging from 85° to 90° C. The mixture was cooled and then the acetic acid was distilled out thereof. The resulting oily matter was added with 100 ml of an aqueous 5% acetic acid solution and thus solidified. The resulting solid matter was re-crystallized twice from an aqueous ethanol solution, whereby the intended hydrazone compound (16) was obtained in a quantity of 4.27 gr.

The yield was 75.3%, and the melting point was in the range of from 123.0° to 125.0° C.

| Elementary analysis | Measured value | Calculated value |
|---|---|---|
| C (%) | 71.76 | 72.05 |
| H (%) | 7.54 | 7.47 |
| N (%) | 14.59 | 14.83 |

Figure 5:
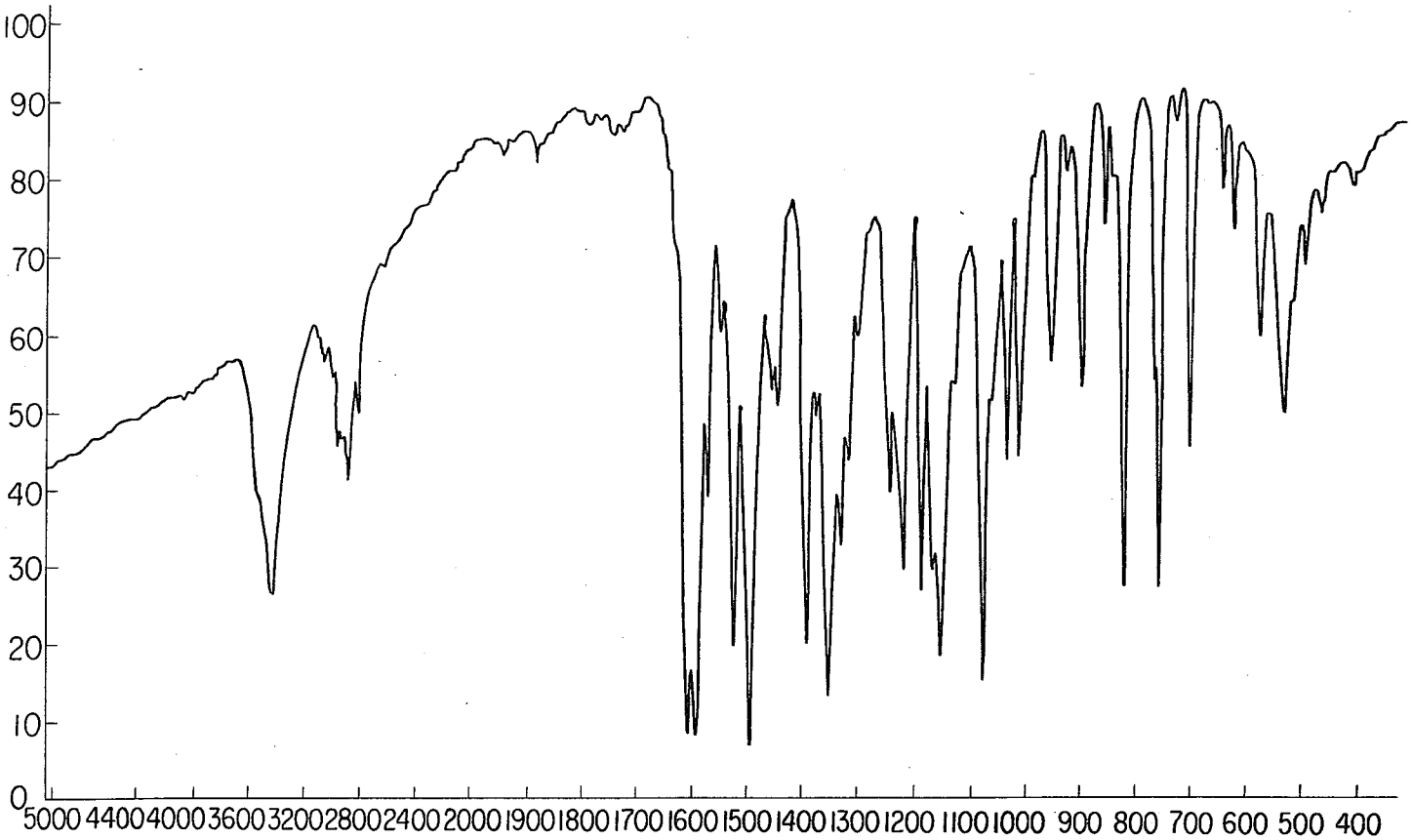

The infrared absorption spectrum of the aforesaid compound (16) (KBr tablet method) is as shown in FIG. 5.

Example 5

Preparation Example of Compound (17)

17.7 gr (0.1 mole) of 4-(N,N-diethylamino)benzaldehyde and 30.4 gr (0.2 mole) of 1-(β-hydroxyethyl)-1-phenylhydrazine were added to 100 ml of acetic acid, and the same was subjected to 1 hour's heating and stirring at a temperature ranging from 70° to 75° C. The mixture was cooled and then 900 ml of water were added thereto and the mixture was stirred. The thus obtained crystals were re-crystallized from a mixed solution of toluene and cyclohexane (1:9 volume ratio), whereby 19.0 gr of the intended hydrazone compound (17) was obtained. The yield was 61.0%, and the melting point was in the range of from 83.5° to 84.5° C.

| Elementary analysis | Measured value | Calculated value |
|---|---|---|
| C (%) | 73.47 | 73.28 |
| H (%) | 8.25 | 8.09 |
| N (%) | 13.22 | 13.49 |

Figure 6:
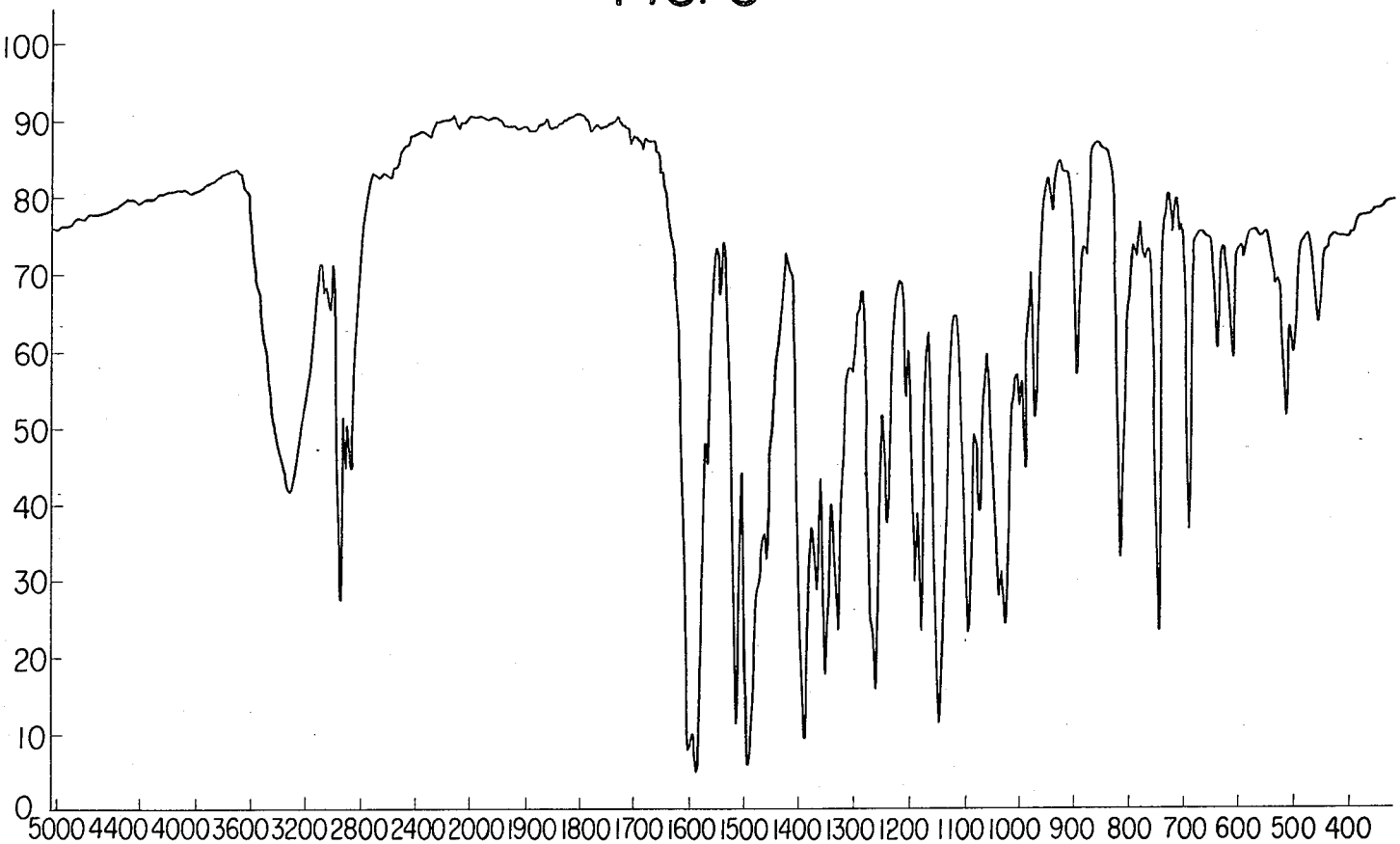

The infrared absorption spectrum (KBr tablet method) of the aforesaid compound (17) is as shown in FIG. 6.

Example 6

To 2 parts by weight of Dian Blue (CI Pigment Blue 25 CI 21180), a disazo pigment having a benzidine skeleton, were added 98 parts by weight of tetrahydrofuran. The resulting mixture was pulverized and mixed in a ball mill, thereby obtaining a charge carrier generating pigment dispersion. This dispersion was coated onto an aluminum-vapordeposited polyester film by means of a doctor blade and air-dried thereby to form a 0.5 micron-thick charge carrier generating layer. Subsequently, a charge transfer layer-forming solution was obtained by mixing and dissolving well 2 parts by weight of the hydrazone compound (1), 3 parts by weight of polycarbonate (Panlite L manufactured by TEIJIN) in 45 parts by weight of tetrahydrofuran. This solution was coated onto said charge carrier generating layer by means of a doctor blade and the same was dried at 100° C. for 10 minutes thereby forming an about 18 micron-thick charge transfer layer. The electrophotographic element No. 1 according to the present invention was thus prepared. This electrophotographic element was subjected to −6 KV corona discharge for 20 seconds by means of an electrostatic copying paper tester (SP 428 type produced by KAWAGUCHI DENKI SEISAKUSHO K.K.) and charged negatively. Thereafter, the negatively charged electrophotographic element was left standing in the dark for 20 seconds to measure the surface potential Vpo (V) at that time, and then was exposed to light from a tungsten lamp so that the surface intensity became 20 lux. Thus, the time (seconds) required until the surface potential was reduced to half of said Vpo was measured to determine the exposure amount $E_{\frac{1}{2}}$ (lux.sec.). The obtained results showed: Vpo = −1020 V and $E_{\frac{1}{2}}$ = 4.6 lux.sec.

Example 7

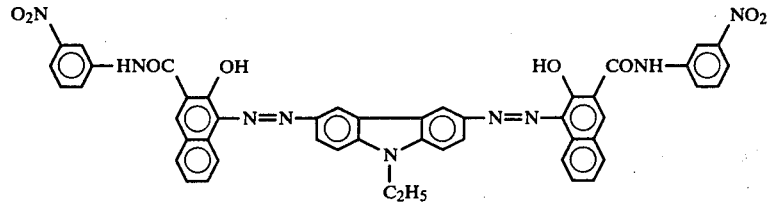

| | |
|---|---|
| (charge carrier generating pigment) | 3 parts by weight |
| Polyester resin (Polyester Adhesive 49000 produced by Du Pont) | 1 part by weight |
| Tetrahydrofuran | 96 parts by weight |

The above-mentioned components were pulverized and mixed in a ball mill, thereby obtaining a charge carrier generating pigment dispersion. This was coated onto an aluminum-vapordeposited polyester film by means of a doctor blade and dried for 5 minutes in a dryer heated to 80° C. to thereby form a 1 micron-thick charge carrier generating layer. Subsequently, a charge transfer layer-forming solution was obtained by mixing and well dissolving 2 parts by weight of hydrazone compound (2), 3 parts by weight of polycarbonate resin (Panlite L) in 45 parts by weight of tetrahydrofuran. This solution was coated onto said charge carrier generating layer by means of a doctor blade and the same was dried at 100° C. for 10 minutes, thereby forming a charge transfer layer having a thickness of about 18 microns. The electrophotographic element No. 2 was thus prepared. This electrophotographic element was charged negatively by the same procedure as Example 6 for measuring the values Vpo and $E_{\frac{1}{2}}$. The thus obtained results showed: Vpo = −1150 V and $E_{\frac{1}{2}}$ = 4.5 lux.sec.

Examples 8 to 9

The same procedure as described in Example 7 was used with the exception that the undermentioned charge carrier generating pigments (A) and (B) and hydrazone compounds (16) and (11) were employed respectively in place of the charge carrier generating pigment and the charge transfer material employed in Example 7, whereby there were prepared electrophotographic elements No. 3 and No. 4.

Charge carrier generating pigment (A)

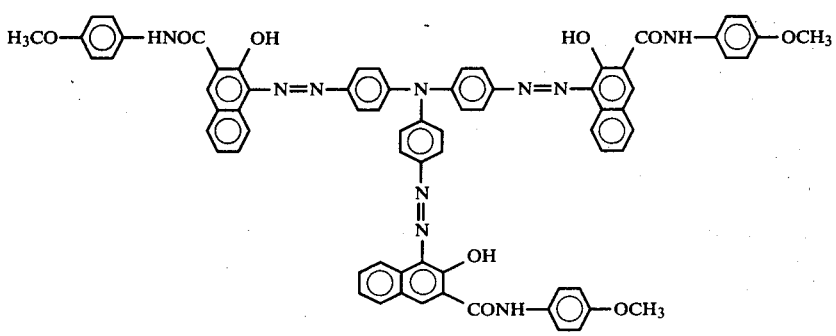

(B)

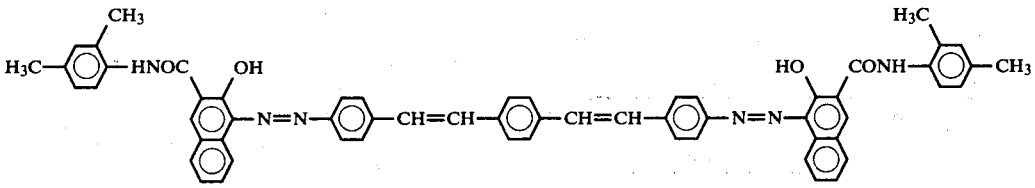

-continued

Charge transfer material (16)

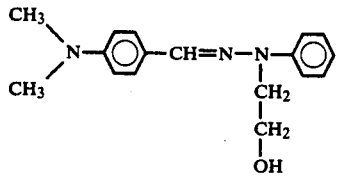

(11)

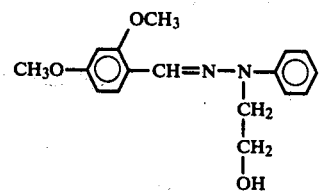

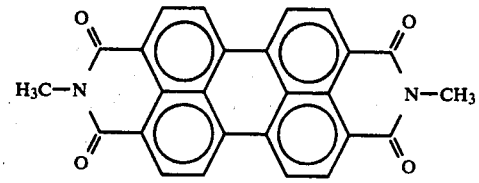

The thus obtained electrophotographic elements No. 3 and No. 4 were subjected to the same procedure as Example 6 for measuring the values of Vpo and $E\frac{1}{2}$. The obtained results are as shown below:

| | Vpo (V) | E1/2 (lux.sec.) |
|---|---|---|
| No. 3 | −1230 | 9.5 |
| No. 4 | −1270 | 2.5 |

The electrophotographic elements obtained according to Example 6 to Example 9 were charged negatively by means of a commercially available copying machine. The thus charged elements were exposed to light through an original, thereby permitting the formation of an electrostatic latent image thereon. This electrostatic latent image was developed by using a dry developer comprising a positively charged toner. The thus developed image was electrostatically transferred onto the surface of paper (wood free paper) and fixed, whereby a clear-cut image was obtained. A clear-cut image was obtained likewise in the case of using a wet developer.

Example 10

Selenium was vacuum vapordeposited in a thickness of 1 micron onto an about 300 micron-thick aluminum plate, thereby forming a charge carrier generating layer. Subsequently a charge transfer layer-forming solution was prepared by mixing and dissolving well 2 parts by weight of hydrazone compound (5), 3 parts by weight of polyester resin (Polyester Adhesive 49000 produced by Du Pont) in 45 parts by weight of tetrahydrofuran. This solution was coated onto said charge carrier generating layer (selenium-vapordeposited layer) by means of a doctor blade, and the same was air-dried and thereafter dried under reduced pressure, thereby forming an about 10 micron-thick charge transfer layer. Thus, the electrophotographic element No. 5 according to the present invention was prepared. This electrophotographic element was subjected to the same procedure as Example 6 for measuring the values of Vpo and $E\frac{1}{2}$. The obtained results showed: Vpo=−950 V and $E\frac{1}{2}$=3.5 lux.sec.

Example 11

A charge carrier generating layer was formed by vacuum vapordepositing a perylene pigment represented by the formula:

to about 0.3 micron thick in place of the selenium employed in Example 10. Subsequently, the electrophotographic element No. 6 was prepared by repeating the same procedure as Example 10 with the exception that a hydrazone compound (9) was employed as the charge transfer material. This element was measured with reference to Vpo and $E\frac{1}{2}$. The obtained results showed: Vpo=−890 V and $E\frac{1}{2}$=6.5 lux.sec.

The electrophotographic elements obtained according to Examples 10 and 11 were charged negatively by means of a commercially available copying machine. The thus charged elements were exposed to light through an original, thereby permitting the formation of an electrostatic latent image thereon. This electrostatic latent image was developed with a dry developer comprising a positively charged toner. The thus developed image was electrostatically transferred onto the surface of paper (wood free paper) and fixed, whereby a clear-cut image was obtained. A clear-cut image was obtained like-wise in the case of using a wet developer.

Example 12

A photosensitive layer-forming solution was prepared by pulverizing a mixture of 1 part by weight of Chloro Dian Blue (which means one wherein Dian Blue includes, in its benzidine nucleus, chloro group in place of the methoxy group) and 158 parts by weight of tetrahydrofuran in a ball mill and mixing, thereafter adding thereto 12 parts by weight of hydrazone compound (24) and 18 parts by weight of polyester resin (Polyester Adhesive 49000 produced by Du Pont) and further mixing. This solution was coated onto an aluminum-vapordeposited polyester film by means of a doctor blade and dried at 100° C. for 30 minutes, thereby forming an about 16 micron-thick photosensitive layer. Thus, the electrophotographic element No. 7 according to the present invention was prepared. This electrophotographic element was subjected to +6 KV corona discharge by using the equipment employed in Example 1 and charged positively. Then, this element was measured with reference to Vpo and $E\frac{1}{2}$. The obtained results showed: Vpo=1350 V and $E\frac{1}{2}$=9.2 lux.sec.

Examples 13 to 15

Electrophotographic elements No. 8, No. 9 and No. 10 were prepared by using the under-mentioned charge carrier generating pigments (C), (D) and (E) and hydrazone compounds (8), (10) and (18) as the charge transfer materials in place of the Chloro Dian Blue and the hydrazone compound (5) employed in Example 12 respectively.

Charge generating pigment

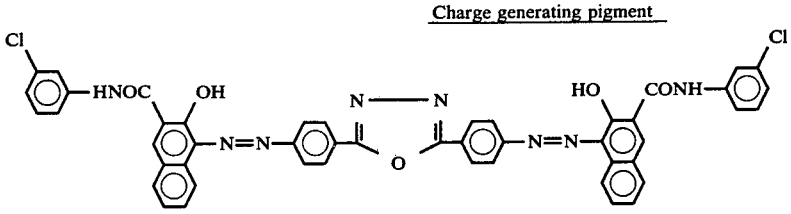

(C)

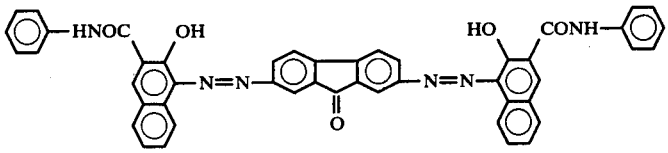

(D)

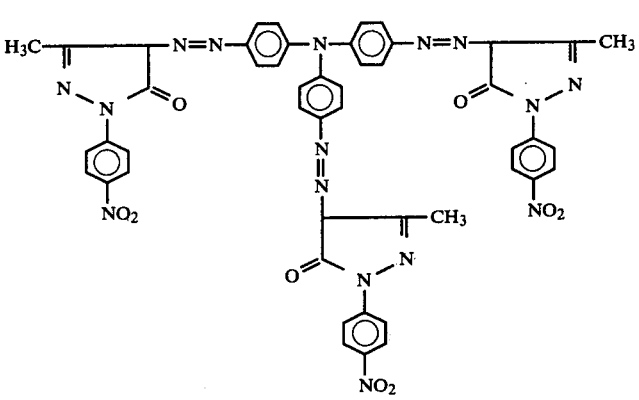

(E)

Charge transfer material (8)

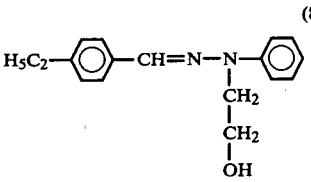

(10)

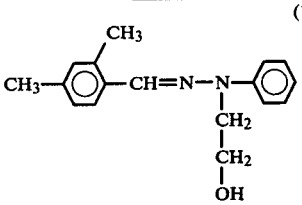

(18)

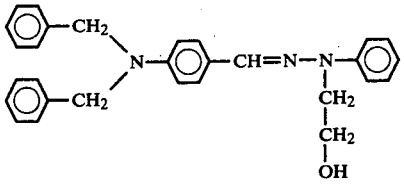

The thus obtained electrophotographic elements No. 8, No. 9 and No. 10 were subjected to the same procedure as Example 12 for measuring Vpo and $E\frac{1}{2}$. The obtained values are as shown below:

| | Vpo (V) | E1/2 (lux.sec.) |
|---|---|---|
| No. 8 | 1030 | 6.7 |
| No. 9 | 1090 | 7.3 |
| No. 10 | 650 | 7.5 |

The electrophotographic elements No. 7 to No. 10 obtained according to Examples 12 to 15 were charged positively by means of a commercially available copying machine. The thus charged elements were exposed to light through an original, thereby permitting the formation of an electrostatic latent image thereon. This electrostatic latent image was developed with a dry developer comprising a negatively charged toner. The thus developed image was electrostatically transferred onto the surface of paper (wood free paper) and fixed, whereby a clear-cut image was obtained. A clear-cut image was obtained likewise in the case of using a wet developer.

Example 16

A dispersion was obtained by pulverizing 3 parts by weight of the charge carrier generating pigment (B) employed in Example 9, 1 part by weight of polyester resin (Polyester Adhesive 49000 produced by Du Pont) and 96 parts by weight of tetrahydrofuran in a ball mill and mixing. This dispersion was coated onto an aluminum-vapordeposited polyester film by means of a doctor blade, and the same was dried in a dryer heated to 80° C. for 5 minutes, whereby there was formed an about 0.1 μm-thick charge carrier generating layer. Subsequently, a solution comprising 1 part by weight of hydrazone compound (17), 1 part by weight of polycarbonate resin and 8 parts by weight of tetrahydrofuran was coated onto said charge carrier generating layer by means of a doctor blade, and the same was dried at 100° C. for 10 minutes, whereby an about 20 micron-thick charge transfer layer was formed.

This electrophotographic element was charged negatively in accordance with the same procedure as Example 6 and then was measured with reference to Vpo and $E_{\frac{1}{2}}$. The thus obtained results showed: Vpo=1263 V and $E_{\frac{1}{2}}$=2.4 lux.sec.

What is claimed is:

1. An electrophotographic element comprising an electrically conductive substrate, a charge carrier generating layer and a charge transfer layer, wherein said charge transfer layer contains at least one hydrazone compound having the formula:

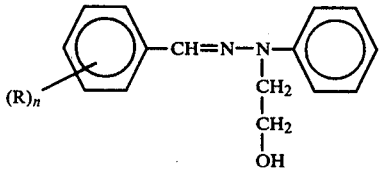

wherein R is hydrogen, alkyl having 1 to 6 carbon atoms, alkoxy having 1 to 6 carbon atoms, dialkylamino group in which each alkyl has 1 to 6 carbon atoms or dibenzylamino, and n is an integer of 1 to 3; and a binder.

2. An electrophotographic element as claimed in claim 1 wherein the charge transfer layer contains a hydrazone compound selected from the group consisting of:

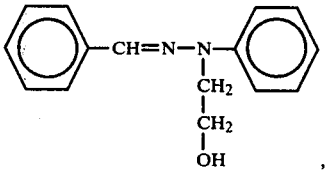

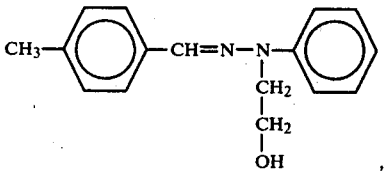

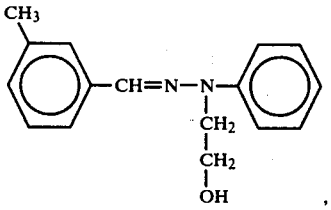

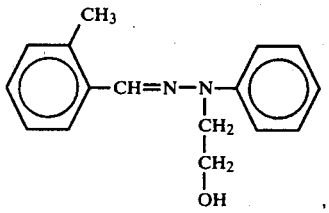

-continued

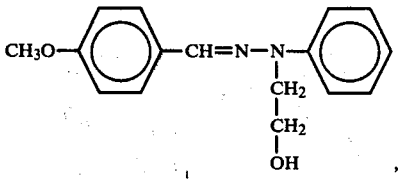

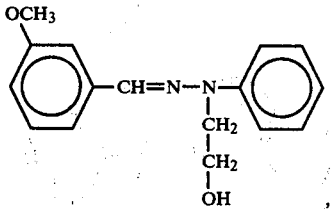

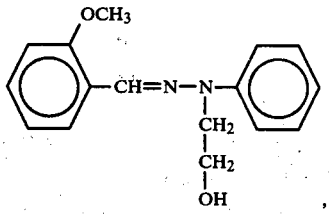

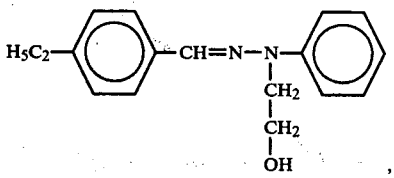

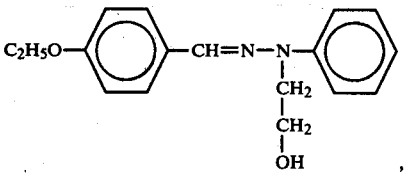

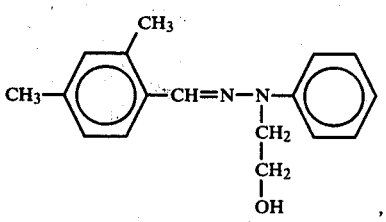

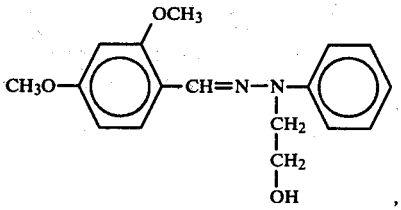

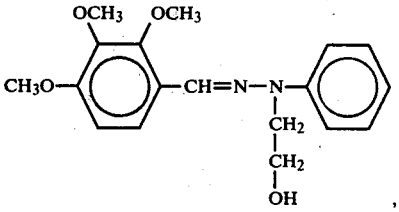

-continued
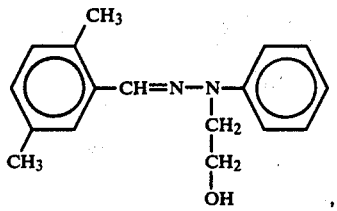
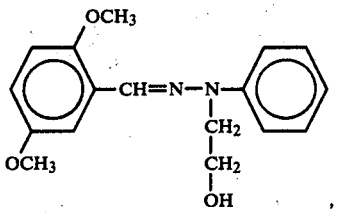
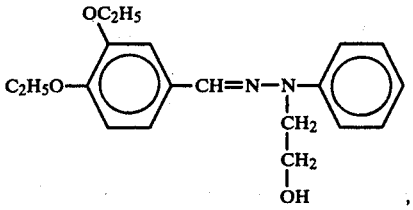
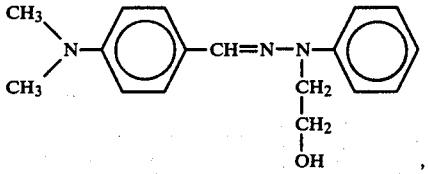
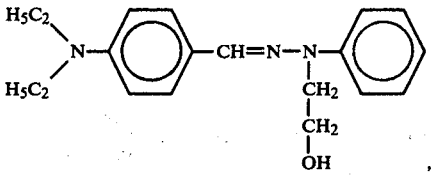
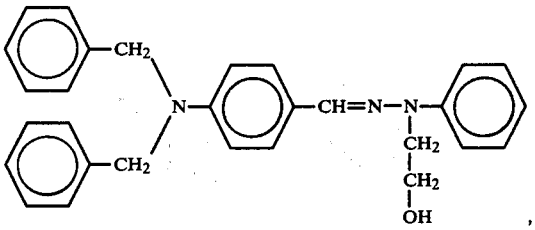
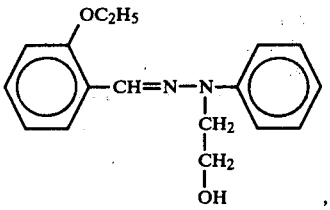
-continued
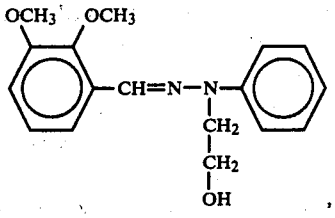
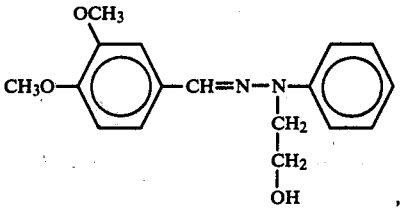
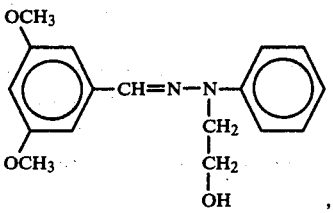
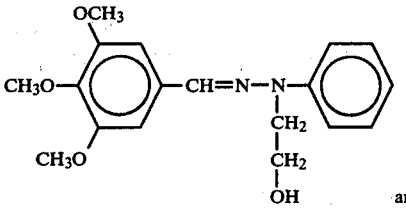
and
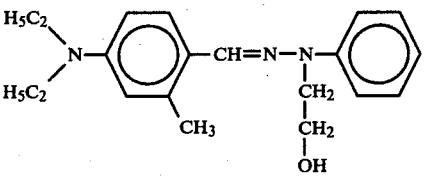
3. An electrophotographic element as claimed in claim 1 wherein the charge transfer layer contains a hydrazone compound selected from the group consisting of:
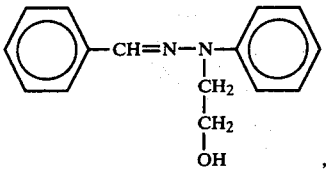
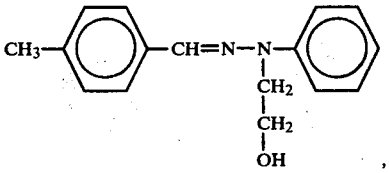

-continued

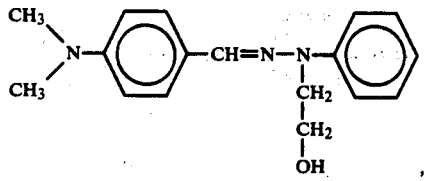

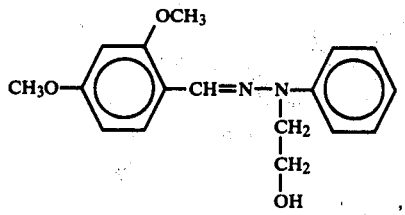

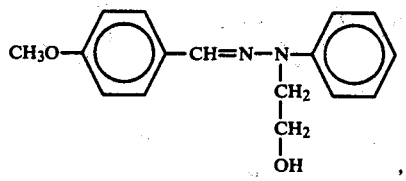

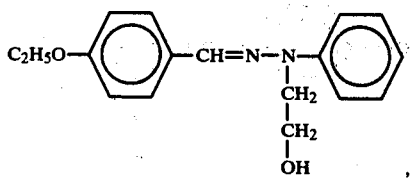

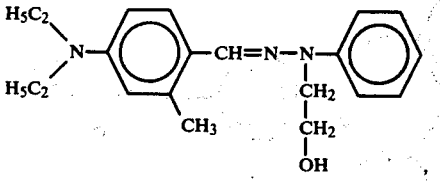

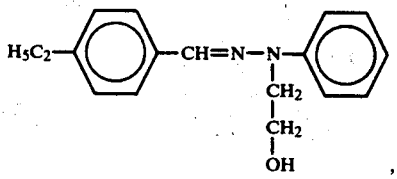

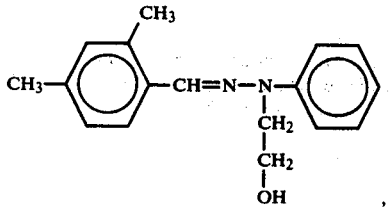

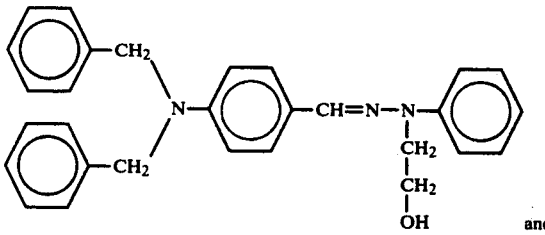

and

-continued

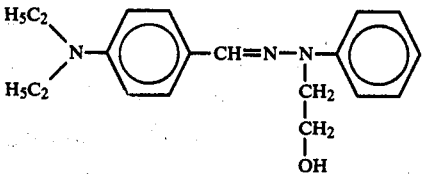

4. An electrophotographic element as claimed in claim 1 wherein the charge carrier generating layer is interposed between the electrically conductive substrate and the charge transfer layer and the charge transfer layer is the exposed upper surface of said element.

5. An electrophotographic element as claimed in claim 1 wherein the thickness of the charge carrier generating layer is 5 microns or less and the thickness of the charge transfer layer is in the range of from 3 to 50 microns.

6. An electrophotographic element as claimed in claim 1 wherein the thickness of the charge carrier generating layer is 2 microns or less and the thickness of the charge transfer layer is in the range of from 5 to 20 microns.

7. An electrophotographic element as claimed in claim 1 wherein the charge carrier generating layer contains a charge carrier generating material selected from the group consisting of selenium and alloys thereof, disazo pigments, trisazo pigments and perylene pigments.

8. An electrophotographic element as claimed in claim 1 wherein the charge carrier generating layer contains a charge carrier generating material selected from the group consisting of a disazo pigment having a benzidine skeleton, a disazo pigment having a carbazole skeleton, a disazo pigment having a triphenylamine skeleton, a disazo pigment having a styrylstilbene skeleton, a disazo pigment having an oxadiazole skeleton and a disazo pigment having a fluorenone skeleton.

9. An electrophotographic element as claimed in claim 8 wherein the binder is one member selected from the group consisting of polyamide, polyurethane, polyester, epoxy resin, polyketone, polycarbonate, polyvinylketone, polystyrene, poly-N-vinylcarbazole, polyacrylamide, acryl resin, and polyvinyl acetal.

10. An electrophotographic element comprising, in successive layers, an electrically conductive substrate, a charge carrier generating layer and a charge transfer layer, wherein said charge carrier generating layer contains a charge carrier generating material selected from the group consisting of selenium, Se alloys, disazo pigments, trisazo pigments and perylene pigments and said charge transfer layer contains at least one hydrazone compound having the formula:

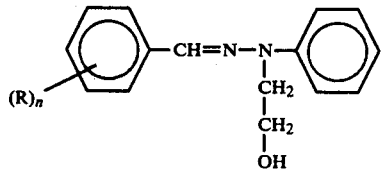

wherein R is hydrogen, alkyl having 1 to 6 carbon atoms, alkoxy having 1 to 6 carbon atoms, dialkylamino in which each alkyl has 1 to 6 carbon atoms or dibenzylamino, and n is an integer of 1 to 3; and a binder.
11. An electrophotographic element as claimed in claim 10 wherein said charge transfer layer contains a hydrazone compound selected from the group consisting of:
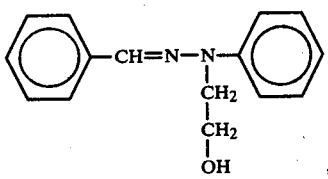
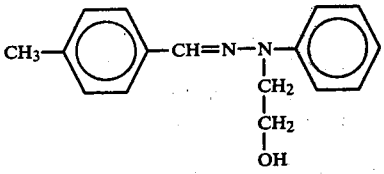
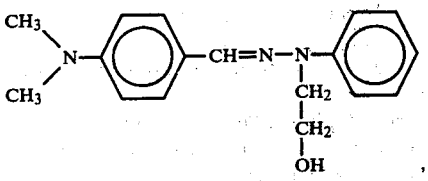
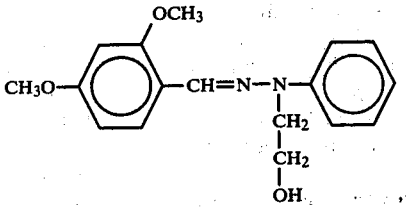
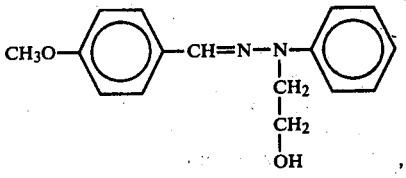
-continued
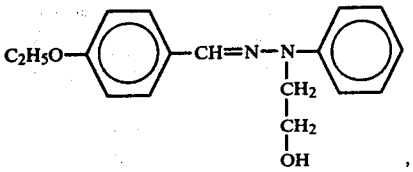
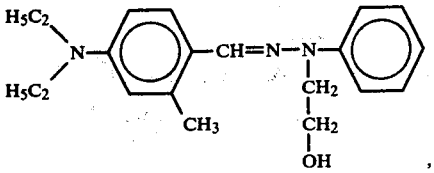
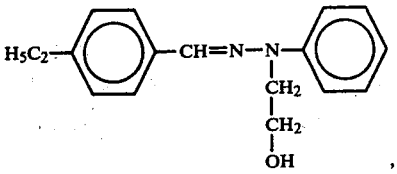
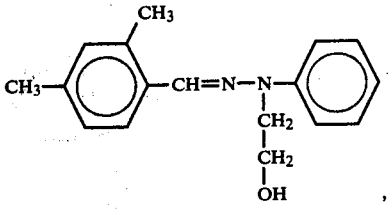
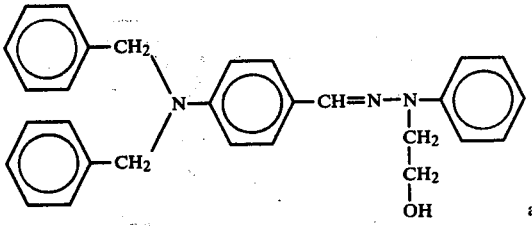
and
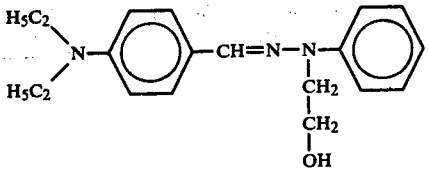
12. An electrophotographic element as claimed in claim 1 or claim 10 wherein n is 2 to 3.
* * * * *